United States Patent [19]

Gupta

[11] 4,321,231

[45] Mar. 23, 1982

[54] PROCESS FOR DECREASING THE RATE OF TITANIUM CORROSION

[75] Inventor: Vijai P. Gupta, Crosby, Tex.

[73] Assignee: Atlantic Richfield Company, Los Angeles, Calif.

[21] Appl. No.: 29,238

[22] Filed: Apr. 11, 1979

[51] Int. Cl.[3] ..... C23F 11/04

[52] U.S. Cl. ..... 422/12; 252/387; 252/389 R; 210/749; 148/6.24; 106/14.21

[58] Field of Search ..... 252/387, 389 R; 148/6.14 R, 6.24; 106/14.05, 14.11, 14.21; 422/12; 210/59; 75/175.5

[56] References Cited

U.S. PATENT DOCUMENTS

| | | | |
|---|---|---|---|
| 2,661,286 | 12/1953 | Swazy et al. | 75/175.5 |
| 2,678,875 | 5/1954 | Spooner | 252/387 X |
| 3,010,854 | 11/1961 | Satterfield | 252/79.3 X |
| 3,457,103 | 7/1969 | Keller et al. | 252/387 |

OTHER PUBLICATIONS

"Corrosion and Protection of Metal Materials Used in Industrial Equipment", pp. 79–90.

Titanium Science and Technology, vol. 4, pp. 2383–2393, (1973).

61 Chem. Abstracts, 7952c, (1964).

*Primary Examiner*—J. L. Barr

*Attorney, Agent, or Firm*—Michael S. Jarosz

[57] ABSTRACT

A process is provided for decreasing the rate of corrosion of titanium by a corrosive aqueous media containing dissolved acidic moieties in contact therewith at an elevated temperature in the substantial absence of molecular oxygen which comprises introducing into said corrosive aqueous medium at least one soluble tellurium or selenium compound or mixtures thereof as corrosion inhibitor, said corrosion inhibitor being introduced in an amount sufficient to provide at least about $1\times10^{-6}$ gram-atoms of dissolved tellurium or selenium values per gram-mole of total acidic moieties in the corrosive aqueous medium.

8 Claims, No Drawings

PROCESS FOR DECREASING THE RATE OF TITANIUM CORROSION

BACKGROUND OF THE INVENTION

1. Field of the Invention

This invention is generally related to the minimization of corrosion of titanium and titanium alloys especially in the substantial absence of molecular oxygen, and, more specifically, to the use of tellurium and/or selenium containing compounds as corrosion inhibitors.

2. Description of the Prior Art

Titanium and titanium alloys are, largely due to their generally high corrosion-resistance properties, widely used in industry as construction material or linings for vessels, piping and the like.

However, unacceptably high rates of corrosion of titanium and its alloys can occur, especially in the substantial absence of molecular oxygen, at elevated temperatures when in contact with certain acid media, e.g., aqueous media containing any of the strong mineral acids, such as nitric acid, phosphoric acid, sulfuric acid, hydrohalic acids (e.g., HBr, HCl, HI and HF), and the like, or any of the strong carboxylic acids, such as oxalic acid, formic acid, acetic acid and the like. Also, aqueous media containing dissolved salts of some of the above acids can vigorously attack titanium and titanium alloys.

Various compounds have been proposed for use as anticorrosive agents for titanium. Thus, U.S. Pat. No. 3,457,103 suggests use of siliceous compounds. Also, $Fe^{3+}$, $Cu^{2+}$ and $Pt^{4+}$, as well as ions of Au, Hg, Zn, Co, Al and Mg, have been found to decrease rates of corrosion or to passivate titanium in certain media. See I. Ya. Klinov, *Corrosion and Protection of Materials Used in Industrial Equipment* pp. 79–90 (Consultants Bureau 1962); *Corrosion* Vol. 19, No. 6, pp. 217t–221t (1963); N. G. Feige et al., *Chem. Eng. Prog.*, Vol. 66, No. 10, pp. 53–56 (1970); J. B. Cotton, *Chem. Eng. Prog.*, Vol. 66, No. 10, pp. 57–62 (1970); T. Koizumi et al., *Corrosion and Corrosion Control*, pp. 318–323 (J. Wiley & Sons 1973); *Titanium Science and Technology*, Vol. 4, pp. 2383–2393 (1973); L. C. Covington, *Titanium Science and Technology*, Vol. 4, pp. 2395–2403 (1973).

Oxyanions ($SO_4^{2-}$, $NO_3^{1-}$, $CrO_4^{2-}$, $PO_3^{3-}$ and $CO_3^{2-}$) have been found to inhibit pitting of titanium in certain specific systems containing halide ions. See, e.g., T. Koizumi, et al., supra at pp. 2388–2392. Also, NaBr has been found to inhibit titanium corrosion in fuming nitric acid. See I. Ya. Klinov, supra at p. 87.

Alloys of Pd, Pt and other metals, notably Mo, have been used to increase resistance of titanium. However, even these alloys are not completely resistant to corrosion attack by acicic aqueous media.

The following references are of interest by way of background, but are much less pertinent than those disclosed above. Tellurium metal has been included in aluminum alloys and copperbase alloys to increase the corrosion resistance to certain media. See N. Nagashima et al., 88 Chem. Abs. 196,070g (1978) and M. Tsuneaki, et al., 68 Chem. Abs. 62,282f (1968), respectively. Water soluble tellurides have been used as corrosion inhibitors for alkaline aqueous engine coolants in contact with ferrous metals, Al, Zn, Cu and Cu alloys. British Pat. No. 961,409, as cited in 61 Chem. Abs. 7952c (1964). Pitting corrosion of stainless steels containing MnTe and CrTe inclusions has been studied. G. S. Eklund, 88 Chem. Abs. 56,4025 (1978). J. E. Antill et al., 88 Chem. Abs. 80,689m (1978) investigated the influence of Te on Cs-enhanced corrosion of stainless steel, and K. Aramaki et al., 87 Chem. Abs. 159,030c (1977) observed the effects of dipropyl telluride as organic corrosion inhbitor for Fe corrosion in perchloric acid. Selenium compounds have been used as components of anti-corrosive coatings for such metals as magnesium, gold, silver, nickel and iron. See A. A. Kudryavtsev, "The Chemistry and Technology of Selenium and Tellurium", p. 229 (Collet's Publishers, Ltd.; London—1974). Se metal has also been included in Ti-containing steels. See V. G. Yusifov, et al., 77 Chem. Abs. 104,517e (1972) (Cr-Ni-Mo-Cu-Se-Ti alloy).

SUMMARY OF THE INVENTION

According to the process of the present invention, the rate of corrosion attack upon titanium and titanium alloys by corrosive aqueous media containing dissolved acidic moieties in the substantial absence of molecular oxygen is decreased by introducing into the acidic media as corrosion inhibitor at least one soluble selenium or tellurium compound in an amount sufficient to provide at least about $1\times10^{-6}$ gram-atoms of dissolved tellurium or selenium values per gram mole of total acidic moieties in said corrosive aqueous media.

The discovery that tellurium and selenium cations can be added to such media to inhibit the corrosion of titanium and titanium alloys from corrosion attack by such media is highly surprising since it has heretofore been known that compounds containing sulfur, also an element of Group VIA of the Periodic Table, can increase the rate of hydride corrosion attack on titanium and can therefore be highly undesirable.

DETAILED DESCRIPTION OF THE INVENTION

The present invention provides substantially decreased rates of corrosion of titanium and titanium alloys. The term "decreased rates of corrosion" as used herein is intended to refer to the relative rates of corrosion of the titanium and titanium alloy by the corrosive aqueous media measured both with and without the use of the corrosion inhibitors of this invention. Desirably, the present invention achieves a rate of corrosion of less than about 25 mpy (1 mpy=0.001 in/yr.), preferably less than about 15 mpy, and more preferably less than about 5 mpy. Most preferably the rate of corrosion is essentially zero, as measured employing any technique having an accuracy of ±0.5 mpy. Obviously, the foregoing absolute rates of corrosion, and decreases in original corrosion rate, are values which will vary widely depending on the nature of the strong acid media, the specific alloy, if any, of titanium, the corrosion inhibitor and its levels used, temperature and a wide variety of other factors. Also, more importantly, the rate of corrosion which can be tolerated in a given application is solely a question of economics. Preferably, an amount of corrosion inhibitor is employed sufficient to provide a treated aqueous medium which is characterized as passive (i.e., substantially noncorrosive), as determined by an anodic polarization curve generated by potentiodynamic polarization analysis employing Method G 5-72, *American Society for Testing and Materials Standards*, Part 10, Pages 660–670 (1972).

The titanium alloys whose corrosion can be inhibited by the process of this invention are those alloys which contain titanium as the base metal, preferably alloys which contain at least 50 weight percent of the alloy as Ti, and which include such metals as aluminum, vanadium, molybdenum, palladium, platinum, nickel, chromium, iron and the like. Typical titanium alloy compositions are set forth in Table I.

TABLE I

| | TITANIUM ALLOYS | | | | | |
|---|---|---|---|---|---|---|
| | Alloy Composition (Wt. %)* | | | | | |
| Element | Ti-50A | Ti-6Al-4V | Ti-Pd | Ti-12 | Ti-140A | Ti-155A |
| Nitrogen, Max. | 0.03 | 0.05 | 0.03 | 0.03 | 0.05 | 0.05 |
| Carbon, Max. | 0.10 | 0.10 | 0.10 | 0.08 | 0.08 | 0.08 |
| Hydrogen, Max. | 0.015 | 0.015 | 0.015 | 0.015 | 0.015 | 0.0125 |
| Iron, Max. | 0.30 | 0.40 | 0.30 | 0.30 | 2.0 | 1.4 |
| Oxygen, Max. | 0.25 | 0.20 | 0.25 | 0.25 | — | — |
| Aluminum | — | 5.5/6.75 | — | — | — | 5.0 |
| Vanadium | — | 3.5/4.5 | — | — | — | — |
| Palladium | — | — | 0.12/0.25 | — | — | — |
| Molybdenum | — | — | — | 0.2/0.4 | 2.0 | 1.2 |
| Nickel | — | — | — | 0.6/0.9 | — | — |
| Chromium | — | — | — | — | 2.0 | 1.4 |
| Titanium | remainder | remainder | remainder | remainder | remainder | remainder |

*Percentages are nominal, not by analysis.

The corrosion inhibitors of the present invention comprise at least one member selected from the group consisting of soluble tellurium compounds, soluble selenium compounds and mixtures thereof. Thus, suitable corrosion inhibitors comprise organic or inorganic compounds of tellurium or selenium which provide cations of these elements in any of their positive valance states, e.g., $Te^{4+}$, $Te^{6+}$, $Se^{4+}$ and $Se^{6+}$, when placed in contact with the aqueous medium to be treated. Exemplary of suitable inorganic tellurium compounds are tellurous acid, the tellurium halides (e.g., $TeBr_6$, $TeBr_4$, $TeCl_2$, $TeCl_4$, $TeI_2$, $TeI_2$, $TeI_4$ and the like), the tellurium oxides (e.g., $TeO_2$, and $TeO_3$ and the like), $Te(NO_3)_2$, $Te(NO_3)_4$, $Te(SO_4)_2$, $Te(SO_4)_4$, $Te(OH)_4$ and $Te(OH)_2$. Exemplary of suitable organic tellurium compounds are the tellurium salts of monocarboxylic acids of 1 to 8 carbon atoms and preferably of 1 to 4 carbon atoms (e.g., $Te(O_2CCH_3)_4$, $Te(O_2CCH_2CH_2CH_3)_4$, $Te(O_2CCH_2CH_3)_4$ and the like), tellurium alkoxides having a total of from 2 to 20 carbon atoms (e.g., $Te(OCH_3)_4$, $Te(OC_2H_5)_4$ and the like), tellurium phenoxide and the like. Exemplary selenium compounds are inorganic compounds such as $H_2SeO_3$, the halides (e.g., $SeBr_2$, $SeBr_4$, $SeCl_2$, $SeF_4$, $SeCl_4$ and the like), the oxides (e.g., $SeO_2$, $SeO_3$ and the like), and organic compounds such as selenium salts of monocarboxylic acids of 1 to 8 carbon atoms, preferably of 1 to 4 carbon atoms (e.g., $Se(O_2CCH_3)_4$ and the like), selenium phenoxide and the like.

The tellurium or selenium can also be added to the strong acid medium as elemental tellurium or selenium, preferably as finely divided solids.

The more preferred anticorrosion agents of this invention are the sources of tellurium cations, most especially the sources of $Te^{4+}$ cation. Of the latter group of tellurium sources, inorganic tellurium ($Te^{4+}$) compounds are most preferred, of which $TeO_2$, $TeBr_4$, $TeCl_4$, $Te(SO_4)_2$, $Te(NO_3)_4$ and $Te(OH)_4$ are exemplary.

The selected tellurium and/or selenium source can be used alone or in combination with any of the corrosion inhibitors of the prior art. Thus, the anion associated with the Te or Se cation can comprise any of the known corrosion inhibiting anions, in which case the Te or Se provides still further anticorrosive benefits. Exemplary of such mixed agents are $Te(SO_4)_4$ or $Te(NO_3)_4$. When such anions or other corrosion inhibitors are employed, the above-defined term "decreased rates of corrosion" will be obviously that decrease in the rate of corrosion attributable to the tellurium or selenium cation of this invention relative to the rate of corrosion employing the anticorrosion anion or other corrosion inhibitors of the prior art.

The corrosive aqueous media which can be treated by the process of this invention comprise aqueous solutions containing acidic moieties. Thus, the media can contain any of the strong mineral acids, strong carboxylic acids or acid salts of the foregoing, which, in solution, may liberate the free acid, and mixtures thereof. These media are severely corrosive to titanium and its alloys, that is, the media will attack the metal surfaces at a rate of at least about 100 mpy, and ususally at least about 200 mpy. Thus, the strong acid media can comprise aqueous solutions of any of the strong mineral acid such as nitric acid, sulfuric acid, hydrohalic acids (e.g., HCl, HBr, HF and HI), chromic acid, sulfonic acids (e.g., benzene or toluene sulfonic acids) and phosphoric acid and the like, any of the strong carboxylic acids such as lower alkanoic acids (e.g., isobutyric acid, formic acid and acetic acid) and oxalic acid and the like, and mixtures thereof, such as aqua regia and chromosulfuric acid. Typical organic salts of the foregoing acids which liberate the acid in solution are the soluble halo-substituted, and especially bromide-substituted, polyols, ethers, esters and the like, e.g., (using, as illustrations, halogenated analogues of ethylene glycol and propylene glycol and their esters and of diethylene glycol and dipropylene glycol and their esters): ethylene dibromide (1,2-dibromoethane); ethylene bromohydrin (1-bromoethan-2-ol); iodoethyl acetate (1-acetoxy-2-iodoethane); diethylene glycol dibromide (2,2'-dibromo-diethylether); 2-chloro-2'-hydroxydiethyl ether; 2-bromo-2'-acetoxy-diethyl ether; ethylene glycol acetate bromoacetate; diethylene glycol acetate bromoacetate; 1,2-dibromopropane; 1-bromopropan-2-ol; 2-chloropropan-1-ol; 1-bromo-2-acetoxypropane; 2-bromo-1-acetoxypropane; 1,1'-dibromo-di-n-propyl ether; 1-bromo-1'-acetoxy-diisopropyl ether; 2-iodo-1'-acetoxy-diisopropyl ether; 1-acetoxy-isopropyl-2'-bromo-n-propyl ether; 2-bromoethyl-1-bromo-propyl ether; ethylene glycol bromoformate; diethylene glycol bromohydrin; ethylene glycol formate bromoformate; diethylene glycol formate bromoformate; vinyl bromide; ethylene glycol bromo acetate; diethylene glycol bromoformate; and the like.

The term "acidic moieties" as used herein is therefore intended to refer to the molar equivalents of the foregoing strong mineral acids or strong carboxylic acids which are present in the corrosive acid media treated by the process of this invention, whether such acids are present initially or are formed in situ, as for example, from any of the above-discussed acid salts which liberate the acid in solution.

The process of this invention finds particular utility in connection with any titanium equipment employed in the processing of aqueous media containing lower alkanoic acids (e.g., formic acid, acetic acid, isobutyric acid and the like), halogenated, especially brominated and/or chlorinated, organic compounds (e.g., brominated derivatives of vicinal glycol esters) or free hydrohalic acid (e.g., HBr, HI or HCl), and more especially those also containing vicinal glycol esters (e.g., mono- and di-alkanoic acid esters of ethylene glycol or propylene glycol), and mixtures thereof.

Such processes include those disclosed in U.S. Pat. Nos. 3,262,969; 3,668,239; 3,689,535; 3,715,388; 3,715,389; 3,743,762; 3,770,813; 3,778,468; 3,872,164; 3,907,874 and 4,073,876, and in Canadian Pat. No. 888,749 which employ the liquid phase reaction of an olefin, a carboxylic acid and molecular oxygen in the presence of a catalyst (e.g., a halide of Te, Se or noble metal) to produce the corresponding vicinal glycol esters, and in which the aqueous reaction mixture withdrawn from the oxidation step is treated, as by distillations, for recovery of the ester product. In these processes, a portion of the aqueous reaction mixture is distilled for separation of an overhead containing mixed gases (e.g., unreacted ethylene and molecular oxygen, together with inerts such as nitrogen and argon and by-product gases such as CO and carbon dioxide), carboxylic acid (e.g., acetic acid and/or formic acid), water and other light materials from the desired ester product and heavies, including various halogenated by-products and catalysts, which can then be recycled to the oxidation step. The vicinal glycol esters produced in such processes can then be hydrolyzed to liberate the glycol, and the glycol can then be recovered from the hydrolysis effluent.

The corrosive aqueous media in the present invention can also optionally contain an organic solvent which can be polar or nonpolar, with polar solvents being more typical. Typical polar organic solvents include carboxylic acid esters such as the lower alkyl esters of lower alkanoic acids (e.g., methyl acetate), ethers such as tetrahydrofuran and p-dioxane, dimethyl ethers of diethylene glycol and of triethylene glycol, alcohols such as t-butyl alcohol and methanol, ether alcohols such as polyglycols, nitriles such as acetonitrile and propionitrile, amides such as dimethyl formamide and dimethylacetamide, ketones such as acetone, methyl ethyl ketone and diethylketone, polar chlorinated hydrocarbons such as chloroform, as well as dimethyl sulfoxide, and the like, as well as alkoxylated ester derivatives of the foregoing ethers and esters such as, for example, ethylene glycol acetate acetoxyacetate ($H_3C(O)COCH_2CH_2OC(O)CH_2OC(O)CH_3$), and diethylene glycol acetate acetoxy acetate. Non-polar solvents include the hydrocarbons such as benzene and the alkanes (e.g., hexane) and chlorinated hydrocarbons such as carbon tetrachloride.

The corrosive aqueous media will be generally characterized by a pH of less than about 2, and more typically less than about 1, as determined employing a combination glass electrode provided with a calomel reference electrode. The corrosive aqueous media will generally contain water, e.g., in a concentration of at least 1 weight percent, and preferably at least 5 weight percent.

The amount of corrosion inhibitor of the process of this invention which should be added in order to be effective in providing a decreased rate of corrosion will vary widely, but the corrosion inhibitor should generally be employed in the corrosive aqueous medium in an amount sufficient to provide at least about $1\times10^{-6}$, and preferably at least about $1\times10^{-5}$, gram-atoms of dissolved tellurium or selenium values (calculated as the Te or Se cation) per gram-mole of total acidic moieties in the corrosive aqueous medium. The maximum amount of selected corrosion inhibitor is solely a question of economics. Generally, however, it will not be necessary to introduce more than about $1\times10^{-2}$, and more typically not more than about $1\times10^{-3}$, gram-atoms of the dissolved Te or Se values per gram-mole of acidic moieties in the corrosive aqueous medium.

The selected corrosion inhibitor of this invention can be introduced into the corrosive aqueous medium by any of the several means, none of which are critical to this invention. Thus, the corrosion inhibitor can be added as a solid or as a solution containing the agent, and can be admixed with the corrosive aqueous medium before or during the contacting of the corrosive aqueous medium with the titanium alloy to be protected against corrosion. Most preferably, the corrosion inhibitor is continually introduced into the corrosive aqueous medium.

With the use of nonvolatile corrosion inhibitors of this invention, it is, naturally, only possible to protect the part of the titanium metal surface which comes into contact with the liquid phase of the corrosive aqueous medium. The parts of the apparatus which come into contact with the vapor of the corrosive aqueous medium or in which the vaporous phase is condensed, can, however, be protected by volatile or sprayable corrosion inhibitors of this invention. Thus, corrosion inhibitors which are themselves liquids and which are soluble in at least one component of the corrosive aqueous media's vapors can be sprayed onto the surface to be protected. Examples of such sprayable liquid corrosion inhibitors of this invention are di-n-butyl telluride, selenium oxybromide, selenium oxychloride and the like. Alternatively, the selected corrosion inhibitor can be dissolved in a suitable solvent (e.g., a polar or nonpolar organic solvent such as those referred to above) to form a liquid containing the corrosion inhibitor which can then be sprayed onto the surface to be protected. Thus, there is included in the present invention a process for protecting titanium surfaces in contact with vapors which are highly acidic in which the surface is precoated or, alternatively, continuously or intermittently contacted as by spraying with, for example, a solution containing the selected corrosion inhibitor.

The corrosion inhibitors of this invention are effective over a wide range of temperatures, and temperature is not a critical operating parameter for this invention. Generally, the corrosive effect of corrosive aqueous media on titanium and its alloys, and hence the amount of corrosion inhibitor necessary to reduce the rate of corrosion to the desired level, will increase with increasing temperature. The corrosion inhibitors of this invention will therefore generally be employed at temperatures of between the freezing point and the bubble point of the corrosive aqueous media at the selected pressure. The temperature will typically range from about −5° to +260° C., and more typically from about +35° to +260° C.

The process of this invention is intended for use in providing corrosion protection in the substantial absence of molecular oxygen, whether dissolved in the corrosive liquid medium or present in the gaseous state. The term "substantial absence of molecular oxygen" is herein meant to refer to partial pressures of molecular oxygen in the gaseous state of less than 15 psia, commonly less than 3 psia, and usually less than 0.5 psia. Of course, the presence of greater amounts of oxygen to retain the non-corrosive nature of the titanium surface is possible but other processing conditions may make this impractical and perhaps even unsafe in the presence of organics due to the possibility of formation of flammable mixtures at one or more points in the apparatus concerned.

The process of this invention can be further illustrated by reference to the following examples, wherein parts are by weight unless otherwise indicated. The potentiodynamic polarization test apparatus used in Examples 5–9 is manufactured by Princeton Applied Research (Model 331-1). The corrosive aqueous media in the Examples possess a pH of less than 2. The gram-moles of acidic moieties in the Examples is calculated based on the gram-moles thereof which are added initially in forming the test liquids.

EXAMPLE 1–3

In a series of experiments, 400 mls. of a liquid mixture containing 9.0 weight percent HBr, 20.0 weight percent water and 71.0 weight percent acetic acid, and in which is dissolved the selected amount of tellurium dioxide as anticorrosion agent, is charged to a 500 cc glass flask provided with a gas sparger, a reflux condenser and a stirring rod (made of titanium Ti-50A) to which is attached a 40×20×1.5 mm coupon of Ti-50A titanium metal having the composition set forth in Table I above. The flask also contains 50 grams of sand in order to minimize the deposition of any solid tellurium on the coupon surface and thereby to ensure that only chemical anticorrosion properties of the added anticorrosion agent will be measured. The flask is sealed and nitrogen is sparged through the liquid at a rate of about 2 cc per minute. The flask is then heated from room temperature to the desired temperature for the selected period of time. The titanium coupon is immersed in the liquid and is rotated by means of the stirring rod at a speed of about 700 rpm throughout the heating period. The nitrogen gas sparging is continued throughout the heating period as well. The sand is substantially evenly dispersed in the liquid by the stirring. After the end of the above period of time, the stirring is discontinued, and the coupon is removed, and its weight and dimensions are measured (to an accurace of $\pm 10^{-5}$ grams; ±0.5 mm) to determine the rate of corrosion of the coupon, thereby yielding the data set forth in Table II below.

TABLE II

| Experiment No. | Temp. (°C.) | Time (Hrs.) | Te* (ppm) | Gram-atoms Te per gram-mole AM** | Rate of Corrosion (mpy) |
|---|---|---|---|---|---|
| Control A | 108 | 61 | 0 | 0 | 412 |
| 1 | 104 | 56 | 384 | $230 \times 10^{-6}$ | 1 |
| 2 | 109 | 140 | 48 | $29 \times 10^{-6}$ | 2 |

TABLE II-continued

| Experiment No. | Temp. (°C.) | Time (Hrs.) | Te* (ppm) | Gram-atoms Te per gram-mole AM** | Rate of Corrosion (mpy) |
|---|---|---|---|---|---|
| 3 | 110 | 94 | 4.8 | $2.9 \times 10^{-6}$ | 372 |

*Added as $TeO_2$.
**"AM" = acid moieties.

The tellurium cation therefore can effect a greatly reduced rate of corrosion of the titanium metal, and the introduction of only $2.9 \times 10^{-6}$ gram-atoms of Te per gram-mole of acidic moieties in the liquid medium reduces the rate of corrosion by about 10 percent.

EXAMPLE 4 FOR COMPARISON

A solution (750 cc) containing 72.8 weight percent acetic acid, 7.6 weight percent formic acid, 16.2 weight percent water, 2.0 weight percent hydrobromic acid (HBr) and 1.4 weight percent ethylene glycol is charged to a one liter glass flask which is provided with a reflux condenser, a nitrogen sparger, a working electrode (5 $cm^2$) of titanium Ti-50A alloy, 2 carbon auxiliary electrodes and a saturated Calomel reference electrode which is provided with a Luggin probe containing a solution whose composition is the same as the liquid to be tested and which is placed to within 2 mm of the working electrode. The liquid is subjected to a potentiodynamic polarization analysis to generate a potentiodynamic anode polarization curve. The anode polarization curve thereby produced characterizes the tested solution as active (i.e., corrosive), passive (i.e., substantially noncorrosive) or unstable (substantially noncorrosive under tested conditions, although subject to industrially undesirable fluctuations in corrosions rates with but minor changes in operating or test conditions). These curves also permit observation of the rest potential, i.e., "$E_{corr}$". N. D. Greene, *Corrosion*, Vol. 18, pp. 136t–142t (1962).

Employing this method of analysis, the solution is determined to have an active corrosion effect on the alloy, and a rest potential of −503 millivolts is observed.

EXAMPLES 5–13

The procedure of Example 4 is repeated except that the liquid subjected to the potentiostatic test contains the selected amount of Te, which is added to the liquid as tellurium dioxide as the anticorrosion agent, thereby yielding the data set forth in Table III below.

TABLE III

| Example No. | Te* (ppm) | Gram-atoms Te per gram-mole AM** | Activity | Rest Potential (mv) |
|---|---|---|---|---|
| 5 | 25 | $14 \times 10^{-6}$ | Passive | +206 |
| 6 | 50 | $28 \times 10^{-6}$ | Passive | +211 |
| 7 | 75 | $42 \times 10^{-6}$ | Passive | +219 |
| 8 | 126 | $70 \times 10^{-6}$ | Passive | +233 |
| 9 | 176 | $98 \times 10^{-6}$ | Passive | +234 |
| 10 | 225 | $125 \times 10^{-6}$ | Passive | +237 |
| 11 | 275 | $153 \times 10^{-6}$ | Passive | +238 |
| 12 | 509 | $284 \times 10^{-6}$ | Passive | +264 |
| 13 | 943 | $525 \times 10^{-6}$ | Passive | +267 |

*Added as $TeO_2$.
**"AM" = acidic moieties.

EXAMPLE 14

The procedure of Example 4 is repeated except that the corrosion inhibitor comprises tellurium metal which is added in an amount (988 ppm Te metal) to provide about $549\times10^{-6}$ gram-atoms of dissolved Te cation per gram-mole of acidic moieties in a liquid. Analysis by a potentiodynamic polarization shows the Ti metal sample to be passive to corrosion in the acid medium and to have a rest potential of +231 millivolts.

EXAMPLES 15–17

The procedure of Example 4 is repeated using a liquid containing 19.0 weight percent ethylene glycol bromo acetate, 56.7 weight percent acetic acid, 6.3 weight percent formic acid, 9.3 weight percent water, 2.14 weight percent HBr, 3.25 weight percent ethylene glycol monoacetate, and the selected amount of Te, which is added as tellurium dioxide, as the anticorrosion agent. Data thereby obtained are set forth in Table IV below. A solution to which no tellurium compound is added is employed as a control.

TABLE IV

| Example No. | Te* (ppm) | Gram-atoms Te per gram-mole AM** | Activity | Rest Potential (mv) |
|---|---|---|---|---|
| Control B | 0 | 0 | Active | −486 |
| 15 | 9 | $6.3\times10^{-6}$ | Unstable | +172 |
| 16 | 26.3 | $18.5\times10^{-6}$ | Passive | +195 |
| 17 | 50.6 | $35.6\times10^{-6}$ | Passive | +202 |

*Added as $TeO_2$
**"*AM*" = *acidic moieties.*

EXAMPLES 18–21

The procedure of Example 4 is repeated except that the anticorrosion agent employed is tellurium tetrabromide, which is added in amounts sufficient to provide the indicated concentration of Te. The data thereby obtained is set forth in Table V below.

TABLE V

| Example No. | Te* (ppm) | Gram-atoms Te per gram-mole AM** | Activity | Rest Potential (mv) |
|---|---|---|---|---|
| 18 | 5.0 | $2.8\times10^{-6}$ | Unstable | +166 |
| 19 | 9.6 | $5.3\times10^{-6}$ | Unstable | +179 |
| 20 | 25.1 | $14.0\times10^{-6}$ | Passive | +193 |
| 21 | 53.6 | $29.9\times10^{-6}$ | Passive | +205 |

*Added as $TeBr_4$
**"*AM*" = *acidic moieties.*

EXAMPLES 22–26

Following the procedure of Example 4, a liquid containing 2.55 weight percent HBr, 2.7 weight percent ethylene glycol bromo acetate, 59.4 weight percent acetic acid, 6.6 weight percent formic acid, 9.2 weight percent water, 9.8 weight percent ethylene glycol diacetate and 9.8 weight percent ethylene glycol monoacetate is tested for corrosion effects using the desired added amount of tellurium (added as tellurium tetrabromide). A control is employed in which the tested liquid contains no added tellurium compound. The data thereby obtained are set forth in Table VI below.

TABLE VI

| Example No. | Te* (ppm) | Gram-atoms Te per gram-mole AM** | Activity | Rest Potential (mv) |
|---|---|---|---|---|
| Control C | 0 | 0 | Active | −451 |
| 22 | 4.8 | $3.2\times10^{-6}$ | Unstable | +169 |
| 23 | 10.3 | $6.9\times10^{-6}$ | Unstable | +159 |
| 24 | 25.7 | $17.1\times10^{-6}$ | Passive | +164 |
| 25 | 51.1 | $34.0\times10^{-6}$ | Passive | +173 |
| 26 | 103.6 | $69.1\times10^{-6}$ | Passive | +180 |

*Added as $TeBr_4$
**"*AM*" = *acidic moieties.*

EXAMPLE 27

Following the procedure of Example 4, a liquid containing 72.8 weight percent acetic acid, 7.6 weight percent formic acid, 16.2 weight percent water, 2.0 weight percent HBr and 1.4 weight percent ethylene glycol is tested for corrosion effects. An amount of selenous acid necessary to achieve the indicated Se concentration is added to the liquid in successive runs. The data thereby obtained are set forth in Table V below.

TABLE V

| Run No. | Se* (ppm) | Gram-atoms Se per gram-mole AM** | Activity | Rest Potential (mv) |
|---|---|---|---|---|
| 1 | 0 | 0 | Active | −514 |
| 2 | 20 | $18\times10^{-6}$ | Active | −453 |
| 3 | 50 | $45\times10^{-6}$ | Passive | +83 |
| 4 | 100 | $90\times10^{-6}$ | Passive | +260 |
| 5 | 150 | $135\times10^{-6}$ | Passive | +290 |

*Added as $H_2SeO_3$
**"*AM*" = *acidic moieties.*

It will be obvious that various changes and modifications can be made without departing from the invention, and it is intended, therefore, that all matter contained in the foregoing description shall be interpreted as illustrative only and not as limitative of the invention.

I claim:

1. A process for decreasing the rate of corrosion of titanium and titanium alloys in the presence of a corrosive aqueous medium containing acidic moieties in contact therewith at elevated temperature in the substantial absence of molecular oxygen which comprises providing in the corrosive aqueous media a corrosion inhibitor selected from the group consisting of a compound of tellurium, selenium and mixtures thereof, said compound being capable of providing cations of these elements in any of their positive valence states when contacted with the said corrosive aqueous media, in an amount sufficient to provide at least about $1\times10^{-6}$ gram-atoms of dissolved tellurium or selenium values per gram-mole of acidic moieties in the corrosive aqueous medium.

2. The process as defined in claim 1 wherein the titanium alloys comprise alloys containing titanium as the base metal and containing at least one member of the group consisting of aluminum, vanadium, molybdenum, palladium, nickel, chromium and iron.

3. The process as defined in claim 1 wherein the corrosion inhibitor comprises at least one member selected from the group consisting of inorganic and organic tellurium compounds containing tellurium in a positive valence state, inorganic and organic selenium compounds containing selenium in a positive valence state, elemental tellurium, and elemental selenium.

4. The process as defined in claim 1 wherein the corrosive aqueous medium possesses a pH of less than about 2 and contains at least one acid selected from the group consisting of $HNO_3$, $H_2SO_4$, HCl, HBr, HI, HF, lower alkanoic acids, phosphoric acid, chromic acid, benzene sulfonic acid and toluene sulfonic acid.

5. The process as defined in claim 1 wherein the corrosive aqueous medium contains at least 1 weight percent water.

6. The process as defined in claim 1 wherein the corrosion inhibitor is employed in an amount sufficient to provide a passive potentiodynamic polarization scan.

7. The process as defined in claim 1 wherein the corrosion inhibitor comprises a soluble, inorganic tellurium compound.

8. The process as defined in claim 1 wherein the corrosion inhibitor provides Te cations when dissolved in the corrosive aqueous medium.

* * * * *